US009476310B2

(12) United States Patent
Latimer et al.

(10) Patent No.: US 9,476,310 B2
(45) Date of Patent: Oct. 25, 2016

(54) SYSTEMS AND METHODS TO AXIALLY RETAIN BLADES

(71) Applicant: General Electric Company, Schenectady, NY (US)

(72) Inventors: Jeremy Peter Latimer, Greenville, SC (US); Donald Joseph Kasperski, Greenville, SC (US); Thomas R. Tipton, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1092 days.

(21) Appl. No.: 13/655,147

(22) Filed: Oct. 18, 2012

(65) Prior Publication Data

US 2014/0112793 A1 Apr. 24, 2014

(51) Int. Cl.
*F01D 5/30* (2006.01)
*F01D 5/32* (2006.01)

(52) U.S. Cl.
CPC ..... *F01D 5/3053* (2013.01); *F01D 5/3007* (2013.01); *F01D 5/326* (2013.01)

(58) Field of Classification Search
None
See application file for complete search history.

(56) References Cited

U.S. PATENT DOCUMENTS

| | | | | |
|---|---|---|---|---|
| 2,713,991 | A * | 7/1955 | Secord | F01D 5/326 416/218 |
| 3,689,177 | A * | 9/1972 | Klassen | F01D 5/06 415/173.7 |
| 4,221,542 | A * | 9/1980 | Acres et al. | 416/220 R |
| 5,256,035 | A * | 10/1993 | Norris et al. | 416/220 R |
| 7,290,988 | B2 * | 11/2007 | Boston | F01D 5/3015 416/220 R |
| 2011/0014053 | A1 * | 1/2011 | Eastman et al. | 416/220 R |
| 2011/0311366 | A1 | 12/2011 | Chanteloup | |

FOREIGN PATENT DOCUMENTS

WO WO 2010067024 A2 * 6/2010

* cited by examiner

*Primary Examiner* — Ninh H Nguyen
*Assistant Examiner* — Justin Seabe
(74) *Attorney, Agent, or Firm* — Sutherland Asbill & Brennan LLP

(57) ABSTRACT

Embodiments of the present disclosure include a gas turbine engine system. The system may include a rotor wheel having a number of blades mounted about a periphery of the rotor wheel. Further, the system may include a retention device. The retention device may include a number of projections extending from a radial surface of the rotor wheel to form a number of circumferential slots about the rotor wheel. The retention device may also include a number of elongated members positioned within the circumferential slots to impede axial movement of the blades.

9 Claims, 7 Drawing Sheets

SYSTEMS AND METHODS TO AXIALLY RETAIN BLADES

FIELD OF THE DISCLOSURE

Embodiments of the present disclosure relate generally to gas turbine engines and more particularly to systems and methods to axially retain one or more blades.

BACKGROUND OF THE DISCLOSURE

Gas turbine engines are widely used in industrial and commercial operations. A typical gas turbine engine includes a compressor at the front, one or more combustors around the middle, and a turbine at the rear. The compressor imparts kinetic energy to the working fluid (e.g., air) to produce a compressed working fluid at a highly energized state. The compressed working fluid exits the compressor and flows to the combustors where it mixes with fuel and ignites to generate combustion gases having a high temperature and pressure. The combustion gases flow to the turbine where they expand to produce work. For example, expansion of the combustion gases in the turbine may rotate a shaft connected to a generator to produce electricity.

During normal operation, thermal and mechanical loads act upon each blade in the compressor and/or turbine. During abnormal operation (e.g., compressor surge, blade-out, etc.), these loads can be extraordinarily large. Accordingly, a means for axially retaining blades is required in order to keep the blades axially positioned during both normal and abnormal operation of the gas turbine engine.

BRIEF DESCRIPTION OF THE DISCLOSURE

Some or all of the above needs and/or problems may be addressed by certain embodiments of the present disclosure. According to one embodiment, there is disclosed a gas turbine engine system. The system may include a rotor wheel having a number of blades mounted about a periphery of the rotor wheel. Further, the system may include a retention device. The retention device may include a number of projections extending from a radial surface of the rotor wheel to form a number of circumferential slots about the rotor wheel. The retention device may also include a number of elongated members positioned within the circumferential slots to impede axial movement of the blades.

According to another embodiment, there is disclosed a method of axially retaining a number of blades. The method may include mounting the blades about a periphery of a rotor wheel. The method may also include positioning a number of elongated members within a number of circumferential slots formed by a number of projections extending from a radial surface of the rotor wheel to impede axial movement of the blades.

Further, according to another embodiment, there is disclosed a gas turbine engine system. The system may include a rotor wheel, a number of blades mounted about a periphery of the rotor wheel, and a retention device. The retention device may include a number of projections extending from a radial surface of the rotor wheel to form a number of circumferential slots about the rotor wheel. The retention device may also include a number of elongated members positioned within the circumferential slots to impede axial movement of the blades. The retention device may also include a number of supports positioned about the circumferential slots to impede radial inward movement of the elongated members. Further, the system may include a number of stops positioned about the circumferential slots to impede circumferential movement of the elongated members.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE DISCLOSURE

Illustrative embodiments will now be described more fully hereinafter with reference to the accompanying drawings, in which some, but not all embodiments are shown. The present disclosure may be embodied in many different forms and should not be construed as limited to the embodiments set forth herein. Like numbers refer to like elements throughout.

Figure 1:
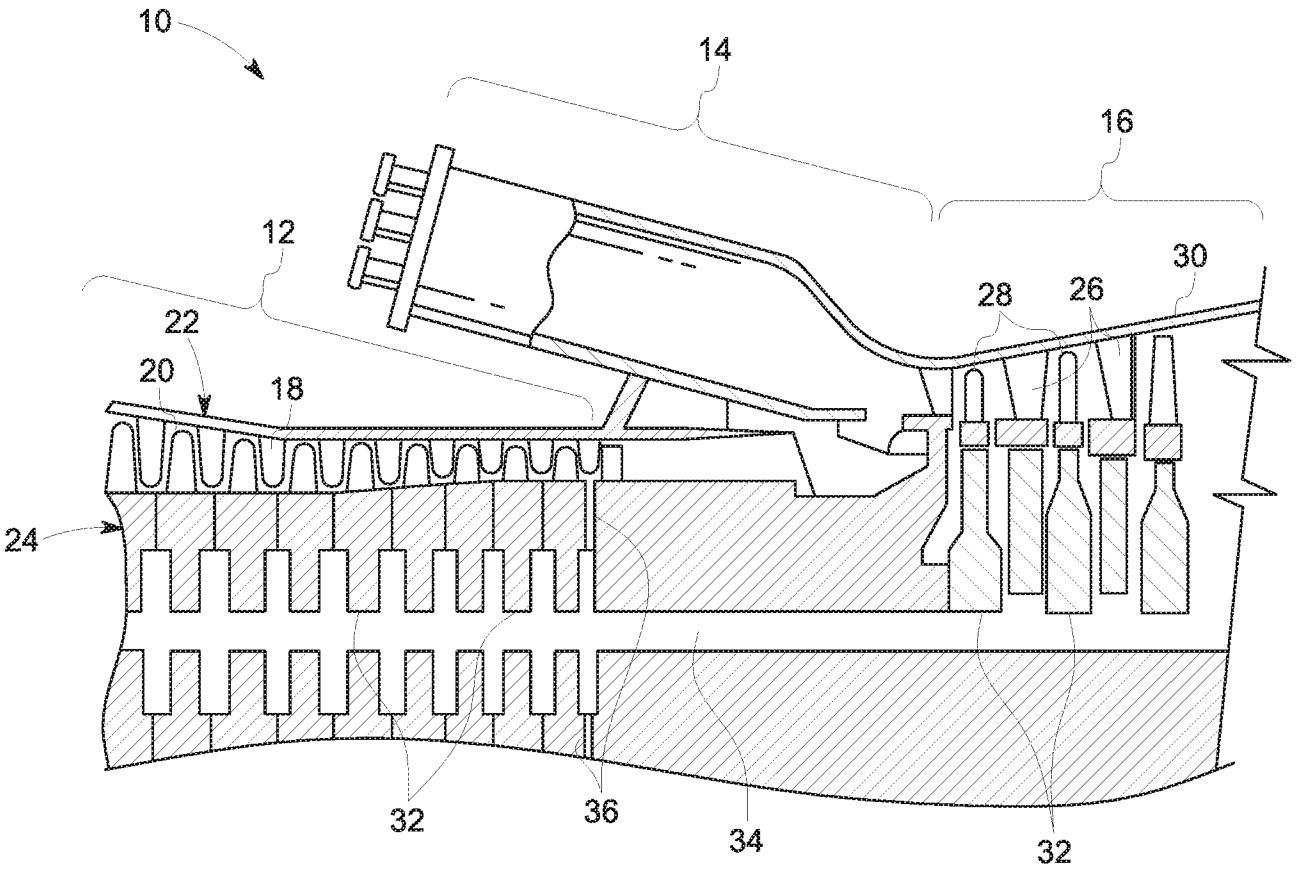
FIG. 1 is an example cross-sectional view of a gas turbine engine, according to an embodiment.

FIG. 1 provides a cross-section view of an exemplary gas turbine 10 to illustrate various embodiments herein. As shown, the gas turbine 10 may generally include a compressor 12, one or more combustors 14 downstream from the compressor 12, and a turbine 16 downstream from the combustors 14. The compressor 12 may generally include alternating stages of axially aligned stator vanes 18 and rotating blades 20. The stator vanes 18 may be circumferentially connected to a compressor casing 22, and the rotating blades 20 may be circumferentially connected to a rotor 24. As the rotor 24 turns, the rotating blades 20 may progressively impart kinetic energy to a working fluid (e.g., air) to produce a compressed working fluid at a highly energized state. The compressed working fluid may then flow to one or more combustors 14 radially arranged around the rotor 24 where it may mix with fuel and ignites to produce combustion gases having a high temperature and pressure. The combustion gases may exit the combustors 14 and flow along a hot gas path through the turbine 16. The turbine 16 may include alternating stages of axially aligned stator vanes 26 and rotating blades 28. The stator vanes 26 may be circumferentially connected to a turbine casing 30, and the rotating blades 28 may be circumferentially connected to the rotor 24. Each stage of stator vanes 26 may direct and accelerate the combustion gases onto the downstream stage of rotating blades 28 to produce work.

As depicted in FIG. 1, the rotor 24 may include a number of rotor bodies or wheels 32 axially aligned and connected to transmit torque between the turbine 16 and the compressor 12. Each rotor body or wheel 32 may include one or more cavities that form an axial bore 34 through the rotor 24. One or more of the adjacent rotor wheels 32 may include a fluid passage 36 that provides fluid communication between the compressor 12 and the bore 34. In this manner, a portion of the compressed working fluid from the compressor 12 may be diverted around or bypass the combustors 14 and supplied directly to the turbine 16 for various reasons. For example, the diverted fluid may be used to pressurize the rotor cavities to produce a desired differential pressure between the rotor cavities and the hot gas path in the turbine 16. Alternately, or in addition, the diverted fluid may be used to provide cooling to various components in the turbine 16.

Figure 2:
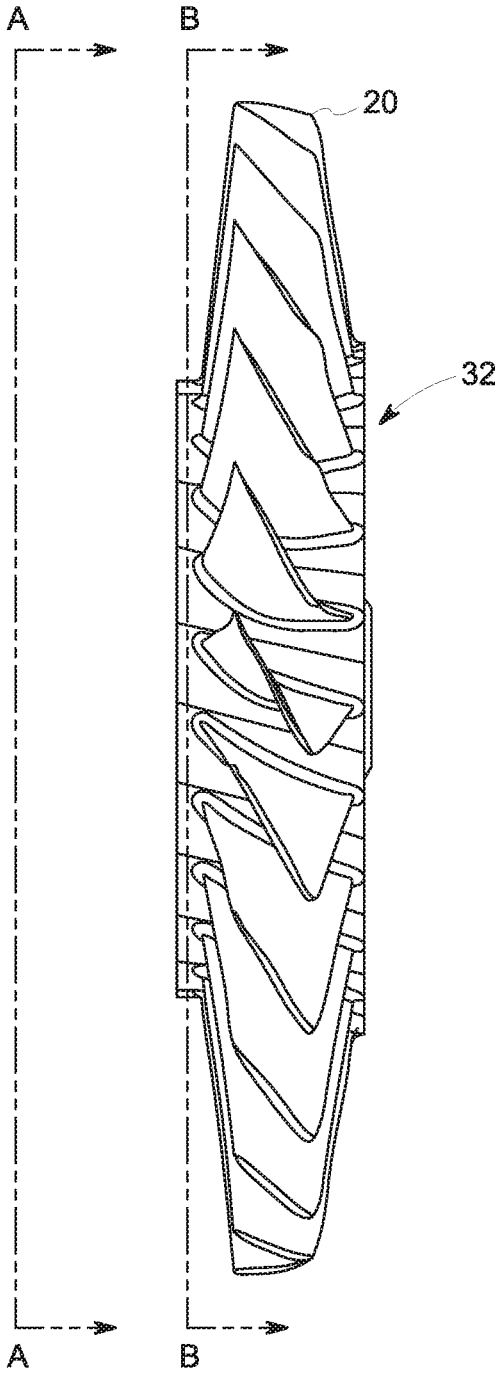
FIG. 2 is an example side view of a rotor wheel assembly, according to an embodiment.
Figure 3:
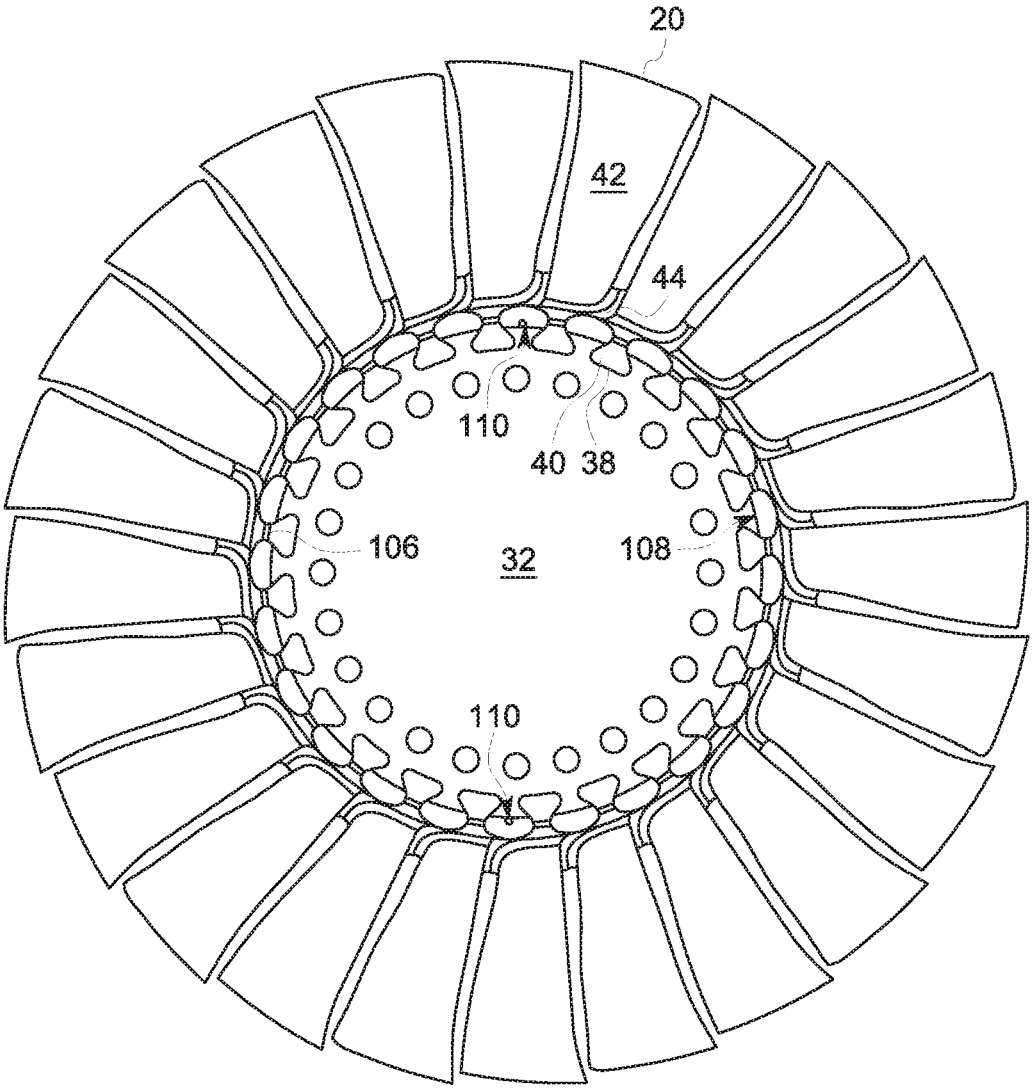
FIG. 3 is an example front view of the rotor wheel assembly of FIG. 2 taken at A-A, according to an embodiment.
Figure 4:
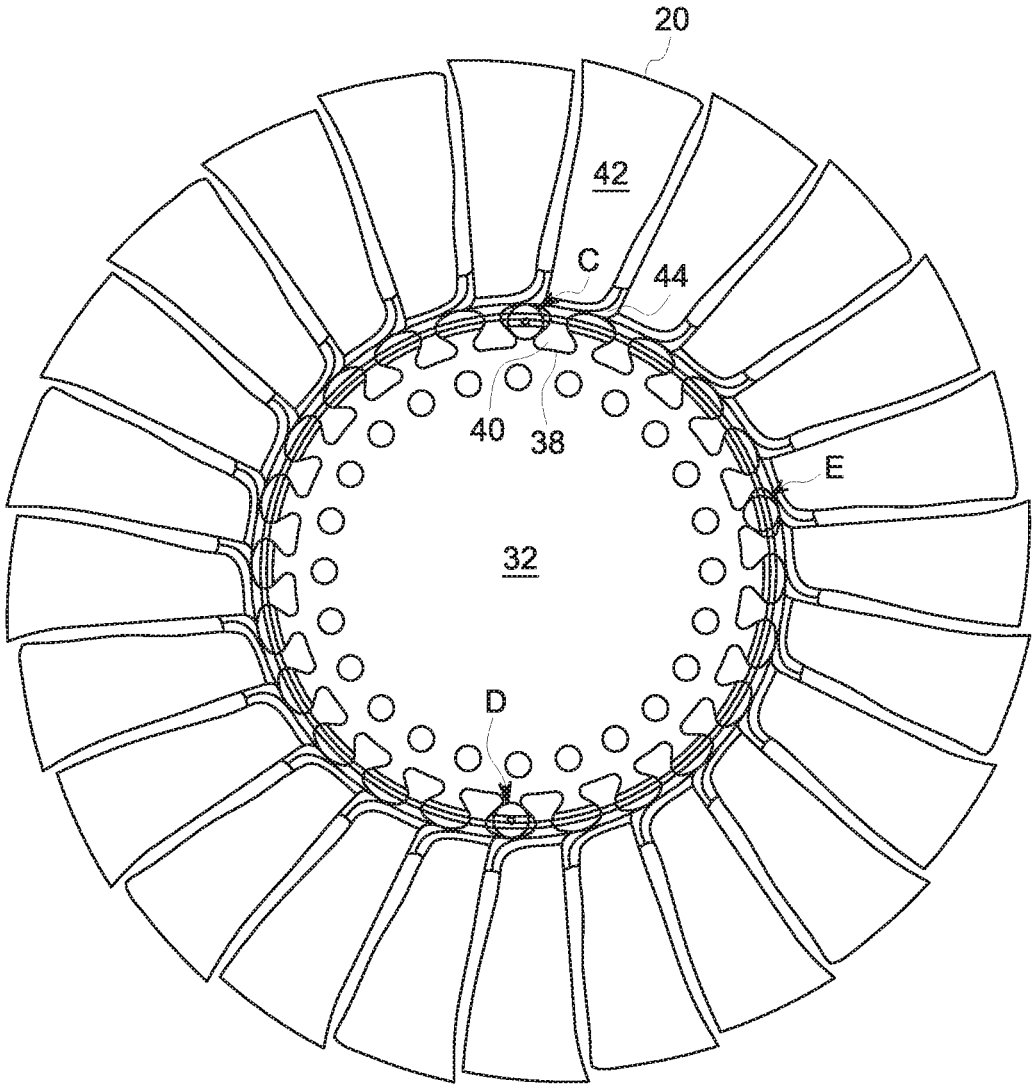
FIG. 4 is an example cross-sectional view of the rotor wheel assembly of FIG. 2 taken at B-B, according to an embodiment.

FIGS. 2-4 depict the rotor wheel 32 according to one embodiment. As shown, the outer circumference (or periphery) of the rotor wheel 32 may include a number of dovetail slots 38 configured to receive corresponding dovetails 40 of the compressor rotating blades 20. For example, in some embodiments, each rotating blade 20 may generally include an airfoil 42, a platform 44, and an attachment member, such as the dovetail 40. The rotating blades 20 can be mounted at the periphery of the rotor wheel 32, with the dovetail 40 of each rotating blades 20 being engaged in a corresponding dovetail slot 38 that opens out into the periphery of the rotor wheel 32 and that extends axially between two opposite surfaces of the rotor wheel 32. In this manner, the dovetail 40 of each rotating blades 20 may be axially inserted into a dovetail slot 38 of the rotor wheel 32.

Figure 5:
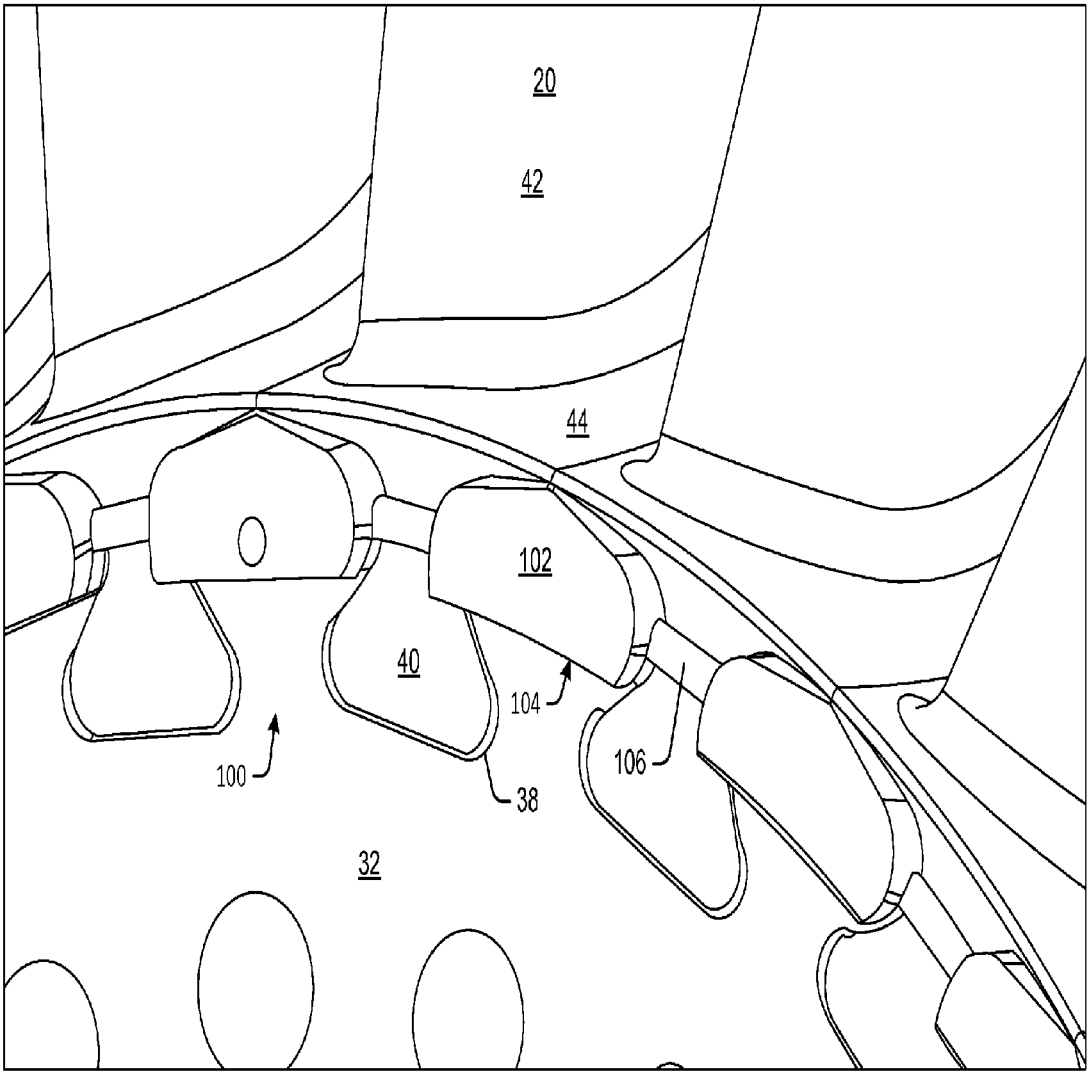
FIG. 5 is an example perspective view of a rotor wheel assembly, according to an embodiment.

As depicted in FIG. 5, the rotor wheel 32 may include a retention device 100 configured to axially retain the rotating blades 20. That is, the retention device 100 may lock (or impede) the rotating blades 20 axially relative to the axis of rotation of the rotor wheel 32. In some embodiments, the retention device 100 can include a number of projections 102 extending from a radial surface of the rotor wheel 32 to form a number of circumferential slots 104 about the rotor wheel 32. For example, in some instances, each of the projections 102 may be positioned at a midpoint between adjacent rotating blades 20, with each of the circumferential slots 104 facing an axis of the rotor wheel 32. In this manner, in one embodiment, each of the projections 102 may include a hook-like configuration to form the circumferential slots 104. In some embodiments, each of the circumferential slots 104 may include an arcuate shape that corresponds to, for example, the circumference of the rotor wheel 32.

Still referring to FIG. 5, the retention device 100 device may include a number of elongated members 106 positioned within the circumferential slots 104. The elongated members 106 may be positioned within the circumferential slots 104 so as to impede axial movement of the rotating blades 20. That is, the elongated members 106 may extend circumferentially across the dovetail 40 of each rotating blade 20 disposed within a corresponding dovetail slot 38 so as to prevent or otherwise impede axially movement of the rotating blades 20. In this manner, the rotating blades 20 may be axially retained (or locked) within the rotor wheel 32 when the elongated members 106 are positioned within the circumferential slots 104. In some embodiments, as discussed in greater detail below, the elongated members 106 may collectively form a multi-piece retention ring that extends intermittently and circumferentially about the circumferential slots 104. In other embodiments, each of the elongated members 106 may include an arcuate shape that corresponds to, for example, the arcuate shape of the circumferential slots 104. In some instances, a single elongated member 106 may be positioned about the entire circumference of the retention device 100.

Figure 6:
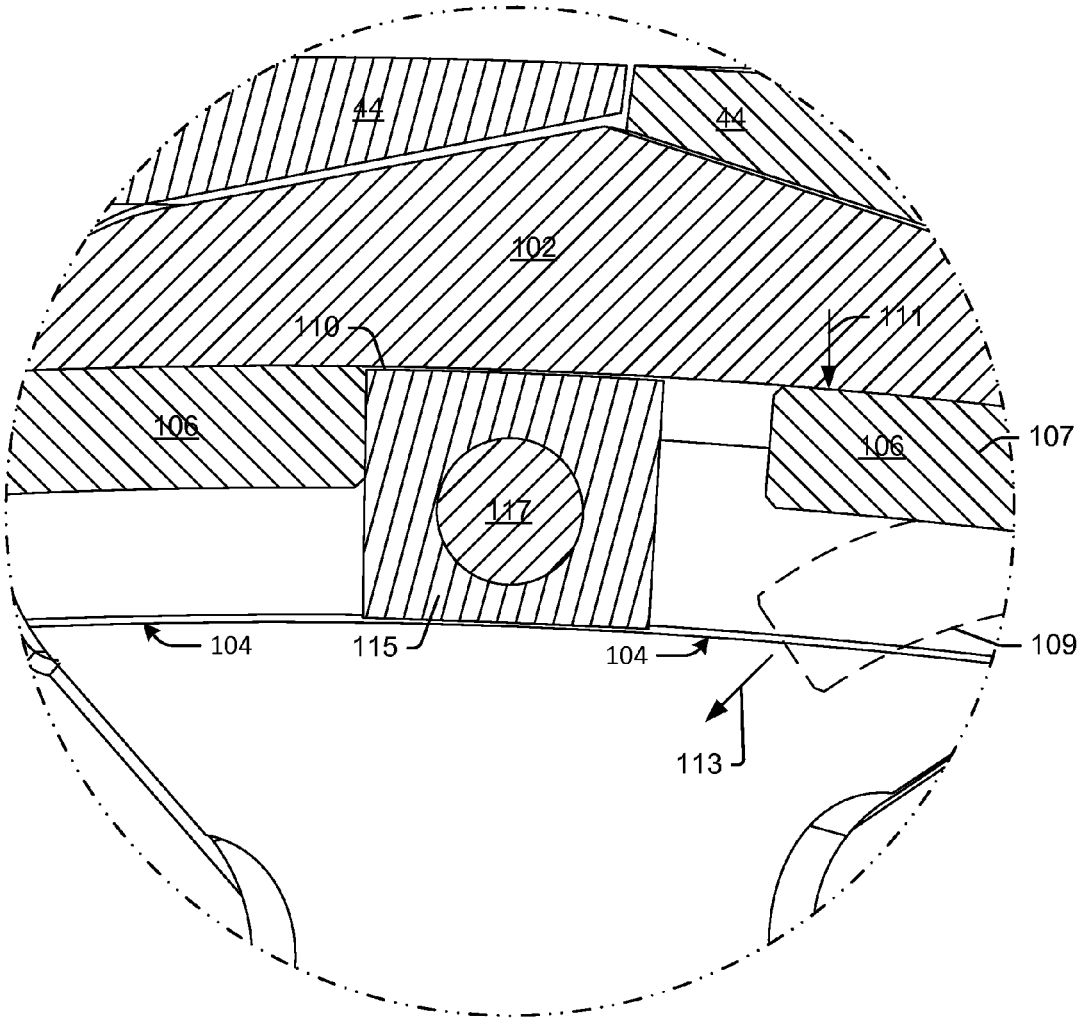
FIG. 6 is an example cross-sectional view of the rotor wheel assembly of FIG. 4 at detail C, according to an embodiment.

In some instances, as depicted in FIG. 6, each of the elongated members 106 may include a resilient elongated member having a first configuration 107 and a second configuration 109. For example, as discussed above, each of the elongated members 106 may be positioned within the circumferential slots 104 so as to impede axial movement of the rotating blades 20. In one embodiment, to remove the elongated members 106 from the circumferential slots 104, an inward radial force 111 may be applied to an end of the elongated members 106 to disengage the end from the circumferential slots 104. In some embodiments, once the end of the elongated member 106 is disengaged from the circumferential slot 104, the remainder of the elongated member 106 may be slid circumferentially, as indicated by arrow 113, until the entire elongated member 106 is removed from the circumferential slots 104. In some embodiments, the elongated members 106 may tend to apply a radially outward force to the circumferential slots 104 due to their resilient characteristics when positioned within the circumferential slots 104.

Still referring to FIG. 6, in certain embodiments, the retention device 100 device may include a number of stops 110 positioned about the circumferential slots 104 to impede circumferential movement of the elongated members 106. In some instances, each of the stops 110 may be disposed proximal to an end of at least two of the elongated members 106. That is, the stop 110 may be positioned between two elongated members 106. In other instances, each of the stops 110 may extend axially through the circumferential slots 104 and abut an end of at least two of the elongated members, i.e., positioned therebetween. In some embodiments, the stops 110 may include a block 115, a pin 117, or a combination thereof.

In one embodiment, the stops 110 may include a first stop positioned at top dead center of the rotor wheel 32 and a second stop positioned at bottom dead center of the rotor wheel 32. That is, the first and second stops may be diametrically opposed from each other. In this manner, the retention device 100 may include elongated members 106 positioned on either side of the two stops 110. Accordingly, the two stops 110 may bifurcate what would otherwise be a continuous retaining ring about the circumferential slots 104. That is, the two elongated members 106 may collectively form a multi-piece retention ring that extends intermittently and circumferentially about the circumferential slots 104, with the ends of the two elongated members 106 being positioned proximal to the first stop and the second stop, respectively.

Figure 7:
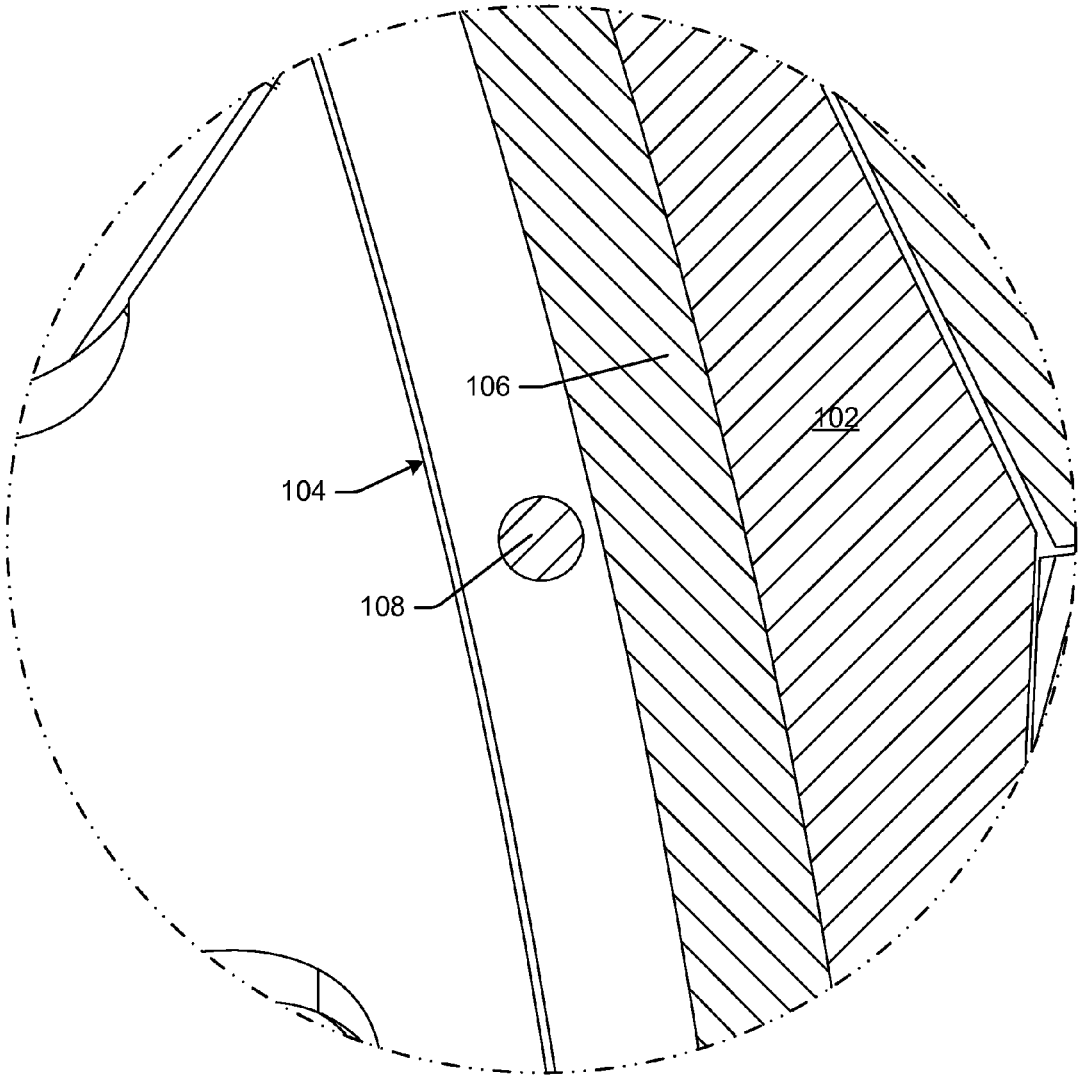
FIG. 7 is an example cross-sectional view of the rotor wheel assembly of FIG. 4 at detail E, according to an embodiment.

As depicted in FIG. 7, in certain embodiments, the retention device 100 device may include a number of supports 108 positioned about the circumferential slots 104 to impede radial inward movement of the elongated members 106. For example, in one embodiment, the supports 108 may each include a pin extending axially through one of the circumferential slots 104. In some instances, the pin may be positioned radially inward of the elongated members 106 to prevent radial inward movement of the elongated members 106. That is, the pin may extend the length of the circumferential slot 104.

According to one embodiment, a technical advantage of the present disclosure is that only the elongated members 106 are removed from the rotor wheel 32 in order to axially remove or retain the blades 20. That is, in some instances, all supports 108 (e.g., pins) and stops 110 (e.g., pins and/or blocks) and other small pieces remain permanently attached to the rotor wheel 32. This reduces the probability that a component will be left un-installed during assembly and/or re-assembly. Embodiments disclosed herein also reduce the probability that small parts will be misplaced and/or left inside the gas turbine engine upon re-assembly. No grinding or cutting is required, which reduces outage time and the potential for component damage. Further, a multi-piece design allows for the assembly/disassembly of the ring on forward stages, as plastic deformation is possible with large 1-piece (360 degree) ring segments during installation. A multi-piece design also facilitates ease of assembly and disassembly due to the reduction in total friction force per elongated member 106. Nevertheless, a 1-piece (360 degree) ring segment is still within the scope of this disclosure.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A gas turbine engine system, comprising:

a rotor wheel;

a plurality of blades mounted about a periphery of the rotor wheel; and a retention device, comprising:

a plurality of projections extending from a radial surface of the rotor wheel to form a plurality of circumferential slots about the rotor wheel, wherein the plurality of projections comprise hooks facing an axis of the rotor wheel;

a plurality of elongated members positioned within the plurality of circumferential slots to impede axial movement of the plurality of blades, wherein each of the plurality of elongated members comprise a resilient elongated member having a first configuration and a second configuration;

a plurality of stops positioned within the plurality of circumferential slots to impede circumferential movement of the plurality of elongated members, wherein the plurality of stops each comprise a block and pin positioned within the hooks of the plurality of circumferential slots; and a plurality of supports positioned about the plurality of circumferential slots to impede radial inward movement of the plurality of elongated members, wherein the plurality of elongated members are removable from the plurality of circumferential slots without removing the plurality of stops and the plurality of supports by applying an inward radial force to an end of the plurality of elongated members to move the plurality of elongated members from the first configuration to the second configuration.

2. The system of claim 1, wherein each of the plurality of projections are positioned about a midpoint between adjacent blades.

3. The system of claim 1, wherein each of the plurality of circumferential slots comprise an arcuate shape.

4. The system of claim 1, wherein the plurality of elongated members collectively form a multi-piece retention ring.

5. The system of claim 1, wherein each of the plurality of elongated members comprise an arcuate shape.

6. The system of claim 1, wherein each of the plurality of supports comprise a pin extending axially through one of the plurality of circumferential slots radially inward of the plurality of elongated members.

7. The system of claim 1, wherein each of the plurality of stops are disposed proximal to an end of at least two of the plurality of elongated members.

8. The system of claim 1, wherein each of the plurality of stops extends axially through the slot and abuts an end of at least two of the plurality of elongated members.

9. The system of claim 1, wherein the plurality of stops comprise:

a first stop positioned at top dead center of the rotor wheel and configured to abut an end of at least two of the plurality of elongated members; and a second stop positioned at bottom dead center of the rotor wheel configured to abut an end of at least two of the plurality of elongated members.

* * * * *